US011225365B2

(12) United States Patent
Tabone

(10) Patent No.: US 11,225,365 B2
(45) Date of Patent: Jan. 18, 2022

(54) CONTAINER BASE AND LID WITH PLANAR AREA FOR FLAT APPLICATION OF ADHESIVE MEMBRANE

(71) Applicant: Maurice Joseph Paul Tabone, Moorebank (AU)

(72) Inventor: Maurice Joseph Paul Tabone, Moorebank (AU)

( * ) Notice: Subject to any disclaimer, the term of this patent is extended or adjusted under 35 U.S.C. 154(b) by 368 days.

(21) Appl. No.: 16/360,964

(22) Filed: Mar. 21, 2019

(65) Prior Publication Data

US 2019/0218003 A1 Jul. 18, 2019

Related U.S. Application Data

(63) Continuation of application No. 15/656,623, filed on Jul. 21, 2017, now Pat. No. 10,287,070, which is a (Continued)

(30) Foreign Application Priority Data

Feb. 12, 2007 (AU) ..... 2007900654
Apr. 30, 2007 (AU) ..... 2007902246

(51) Int. Cl.
*B65D 55/06* (2006.01)
*B65D 43/02* (2006.01)
*B65D 43/16* (2006.01)

(52) U.S. Cl.
CPC ..... *B65D 55/06* (2013.01); *B65D 43/0202* (2013.01); *B65D 43/161* (2013.01); *B65D 43/162* (2013.01); *B65D 2203/02* (2013.01)

(58) Field of Classification Search
CPC .. B65D 55/0818; B65D 55/06; B65D 43/162; B65D 4/163; B65D 2203/02;
(Continued)

(56) References Cited

U.S. PATENT DOCUMENTS 4,312,451 A 1/1982 Forbes, Jr.
4,570,818 A 2/1986 Borst et al.
(Continued)

FOREIGN PATENT DOCUMENTS

AU 2003234951 6/2004
CA 2541375 4/2005
(Continued)

OTHER PUBLICATIONS

International Preliminary Report on Patentability (IPRP), PCT/AU2008/000173 (WO2008098288), dated Apr. 30, 2009.
(Continued)

*Primary Examiner* — Andrew T Kirsch
(74) *Attorney, Agent, or Firm* — Niro McAndrews, LLP

(57) ABSTRACT

The embodiments provide a container (40) of the type to hold fresh food or produce. Container (40) has a base (42) and a lid (44) moveable with respect to the base (42) between an open position and a closed position. The lid (44) has a planar area (54). The base has a second planar area (56). In the closed position, the first planar (54) and the second planar area (56) include a substantially flat area suitable for receipt of an adhesive membrane, such as a self-adhesive label. The substantially flat area includes an edge (55) of the first planar area (54) and at least part of the second planar area (56).

30 Claims, 7 Drawing Sheets

Related U.S. Application Data continuation of application No. 12/449,556, filed as application No. PCT/US2008/000173 on Feb. 12, 2008, now abandoned.

(58) Field of Classification Search

CPC B65D 2251/1016; B65D 23/36; B65D 77/36; B65D 2102/0007; B65D 2401/05; B65D 2203/00; B65D 51/245; B65D 25/205; B65D 25/36

See application file for complete search history.

(56) References Cited

U.S. PATENT DOCUMENTS

| | | | | |
|---|---|---|---|---|
| 4,986,414 | A * | 1/1991 | Ashley | B65D 43/162 206/5.1 |
| 5,018,622 | A | 5/1991 | Hartley | |
| 5,405,009 | A | 4/1995 | Hackenbracht | |
| 5,636,737 | A | 6/1997 | Marsilio | |
| 5,893,587 | A | 4/1999 | Wong | |
| 6,352,170 | B1 | 3/2002 | Brown et al. | |
| 6,540,074 | B1 | 4/2003 | Sankey et al. | |
| 10,574,956 | B2 | 2/2020 | Moule et al. | |
| 2004/0226955 | A1 | 11/2004 | Frantz | |
| 2007/0017845 | A1 | 1/2007 | Tietschert | |
| 2017/0341833 | A1 | 11/2017 | Tabone | |

FOREIGN PATENT DOCUMENTS

| | | |
|---|---|---|
| CN | 1863717 | 11/2006 |
| EP | 1558504 | 8/2005 |
| FR | 2349182 | 11/1977 |
| JP | 2007508207 | 4/2007 |
| WO | WO2005035392 | 4/2005 |
| WO | 2008098288 | 8/2008 |

OTHER PUBLICATIONS

Internet Archive record of Jan. 25, 2005 capture of http://www.avolo.de/s24htm. Accessed on Oct. 30, 2020. 2 pages.

Internet Archive record of Sep. 24, 2006 capture of http://www.hartmann.dk/primary_cms/CMSResources.nsf/filenames/HART_IMAGIC_BROSCH_ENGLISCH.pdf/$file/HART_IMAGIC_BROSCH_ENGLISCH.pdf. Accessed on Oct. 30, 2020. 4 pages.

Internet Archive record of Sep. 24, 2006 capture of http://www.hartmann.dk/primary_cms/CMSResources.nsf/filenames/E-FINAL 02-09-05.pdf/$file/E-FINAL 02-09-05.pdf. Accessed on Oct. 30, 2020. 4 pages.

Internet Archive record of Oct. 4, 2017 capture of http://www.polskiefermy.com.pl/en/10/products/eggs-from-an-alternative-culture/free-range-eggs-86.html. Accessed on Oct. 30, 2020. 2 pages.

Screen capture of http://www.pulpcrafts.com/shows-49-213.html#main. Accessed Oct. 30, 2020. 8 pages.

Screen capture of https://www.shutterstock.com/image-photo/woman-shopping-eggs-organic-grocery-store-1722076957. Accessed Oct. 30, 2020. 1 page.

Internet Archive record of Sep. 24, 2006 capture of http://www.hartmann.dk/primary_cms/CMSResources.nsf/filenames/Sortiment-Englisch.pdf/$file/Sortiment-Englisch.pdf. Accessed on Oct. 30, 2020. 33 pages.

Internet Archive record of Sep. 24, 2006 capture of http://www.hartmann.dk/primary_cms/CMSResources.nsf/filenames/HA_SF_BROSCH%EF%BF%BDRE_ENGLISCH.pdf/$file/HA_SF_BROSCH%EF%BF%BDRE_ENGLISCH.pdf. Accessed on Oct. 30, 2020. 4 pages.

Screen captures of http://www.vintex-green.com/cgi-bin/i8_user_data.cgi?a=d_3nvknFSDuVQ9LhuDoXFhhs35V2wcyjxKNfMN8Vc7-I8ECS-0veFJq8e7NRCmXSK16WYrWfDBysIDLUGq8BvA483 and http://www.vintex-green.com/cgi-bin/i8_user_data_category.cgi7access_code=advanced. Accessed Oct. 30, 2020. 2 pages.

* cited by examiner

CONTAINER BASE AND LID WITH PLANAR AREA FOR FLAT APPLICATION OF ADHESIVE MEMBRANE

RELATED APPLICATIONS

This application is a continuation of U.S. patent application Ser. No. 15/656,623 filed Jul. 21, 2017, which is a continuation of U.S. patent application Ser. No. 12/449,556, filed Aug. 12, 2009, now abandoned, which is a U.S. National Phase entry under 35 U.S.C. § 371 of International Application No. PCT/AU2008/000173, filed Feb. 12, 2008, which claims the benefit under 35 U.S.C. § 119(a) of Australian Application No. 2007902246, filed Apr. 30, 2007, and Australian Application No. 2007900654, filed Feb. 12, 2007.

TECHNICAL FIELD

This disclosure relates to containers. In particular, this disclosure relates to containers intended to hold fresh food or produce, although the scope is not limited to this area. The disclosure is especially concerned with containers in a form which can facilitate application of labels, such as tamper evident labels.

Priority is claimed of Australian Patent Application Nos 2007900654 and 2007902246, the contents of the specifications of which are incorporated herein by reference.

BACKGROUND

Thermoformed containers suitable for holding fresh food or produce are in common use. Traditionally, these have consisted of a base with a lid, the lid being hinged to the base or separate therefrom. In order to secure the lid to the base, these known containers require one or more labels to be adhered to both the lid and the base in a "wrap around" fashion. In high output operations, there is a problem in applying a "wrap around" (non-flat) label because automated equipment is generally designed for flat label application.

In addition, labels applied to containers of this type often carry a barcode, usually along with other information. There can be problems in scanning barcodes on non-flat labels. Consequently, from this point of view, a flat label would be preferred.

It is an object of the present embodiments, at least in some embodiments, to provide a container configuration which permits flat application of labels.

More recently, a dual hinged lid container has been devised. Reference is made to Australian patent No 2003234951. The specification of this patent discloses a container having a lid provided in two parts, each part being hinged to the base. When both lids are closed, there is available a generally flat area across the lid edges in the center of the container top to permit a flat label to be applied. The flat label so applied can act as a tamper evident seal.

While this prior art dual hinged lidded container can work admirably in many applications, there are instances where it is undesirable to apply a label across a join in the center of a container lid in this manner. For example, the label may obstruct a consumer's view of contents of the container, especially where there is a relatively high label-to-lid area ratio. As another example, on larger containers, a regular sized label may prove inadequate to give a tamper evident seal. If the size of the label were to be increased, this would add to label cost and may prove uneconomical. In other instances, it may be desirable to provide a container with increased security.

It is an object of the present embodiments, at least in some embodiments, to alleviate some or all of these concerns or, at the least, to provide a useful alternative which is appropriate for containers of different shapes and sizes.

DISCLOSURE

Accordingly, the present embodiment provides a container having a base and a lid moveable with respect to the base between an open position and a closed position, the lid having a first planar area and the base having a second planar area, wherein, in the closed position, the first and second planar areas include a substantially flat area suitable for receipt of an adhesive membrane, the substantially flat area including an edge of the first planar area and at least part of the second planar area.

The container may be made of any suitable material but preferably is a thermoformed, relatively thin plastic material, as is presently known in the art. Examples of suitable thermoformable plastic material are polyvinyl chloride (PVC), polyethylene terephthalate (PET), polypropylene, polylactide (PLA) and biaxially oriented polystyrene (BOPS). The container may be of any desirable shape. Currently, most popular containers of this type are square or rectangular in cross section and these are encompassed by the present embodiments, along with other shapes.

The base preferably includes a floor and upwardly extending side walls. Preferably, all or at least one of the side walls end at a rim which, in some embodiments, may include the second planar area. If desired, the rim may include means for supporting the container during the selling process. For example, the rim may include a hang sell hole for "off-shelf" display.

The lid or the base may include ventilation holes, ribs or arches or any other modifications suited to intended contents and/or conditions of sale.

The base and upstanding side walls may define an opening which, in use, is horizontal. However, other variations are possible. For example, the base may define an opening which, in use, is vertical and intended to be closed by a lid in a vertical orientation in use.

The lid is moveable with respect to the base between an open position and a closed position. The lid may be hinged or otherwise attached to the base in any suitable manner. Alternately, the lid may be separate from the base, in which case it may be desirable to have two or more first planar areas on the lid and correspondingly two or more second planar areas on the base if tamper evidence is required.

The lid may be generally flat or it may include shaped portions (such as one or more domes, ribs or arches) in addition to the first planar area. Optionally, the lid may include one or more recessed portions which may be useful for storing items which a consumer may require once the container has been opened. Such items may include cutlery, dressings and condiments.

The lid may be of known type, for example an "inside fitting" or an "outside fitting" lid in relation to the base when closed.

The lid may be a single lid or may be a multi-part lid. For example, the embodiments are applicable to the type of dual-lidded container in Australian patent No. 2003234951. An embodiment is shown in the drawings, below. The lid may have more than two parts.

The lid and/or the base may include any suitable mechanical locking mechanisms, such as one or more projections, each receivable in a recess with an interference-type fit. These may be located on surfaces which, in use, are horizontal or vertical, for example. Another example of a locking mechanism is a channel style lock.

The first planar area is on the lid and preferably is greater than 5 cm2. The first planar area is preferably located adjacent an edge of the lid since, when a label or other adhesive membrane is applied, at least part of the purpose is to secure the lid to the base. In a preferred embodiment, the first planar area is located opposite a hinged edge of the lid, when the lid is hinged to be base. However, it is to be understood that the embodiments are not limited to this. The first planar area may be located adjacent any edge of the lid or in any other desired location. For example, the first planar area may be located on a side of the lid (approximately vertical in use.)

The first planar area may be generally parallel to a floor in the base. However, other configurations are possible. For example, the first planar area may be disposed at an angle to some or all of the remainder of the lid. An example is illustrated in the drawings, below.

The second planar area is on the base. This may take any suitable form and many variations are possible. By way of example, the second planar area may be located on a rim for the base or on an extension thereof, optionally inclined at an angle to the rim. The lid may be contoured for a snug fit with the second planar area.

The substantially flat area suitable for receipt of an adhesive membrane includes an edge of the first planar area and at least part of the second planar area. It is intended, or course, that the adhesive membrane (preferably an adhesive label) may be applied to the substantially flat area, connecting the lid and the base in the area of the edge of the first planar area included in the substantially flat area. The first and second planar areas may be adjacent or they may partially overlap. In one view, they may be regarded as generally coplanar, although, strictly speaking, where there is a simple overlap there will be a small step from the first planar area to the second planar area.

The edge of the first planar area may simply abut at least part of the second planar area. In another embodiment, the edge of the first planar area may form a chamfered abutment with at least part of the second planar area. In yet another embodiment, an edge of the first planar area surrounds the second planar area.

The substantially flat area is preferably located at an opposite side of the container to the hinge, or opposite each hinge when there is more than one. However, the embodiments are not limited to this configuration.

It will be appreciated that when the lid is in the closed position, the substantially flat area is preferably suitable for application of an adhesive membrane, such as a self-adhesive label applied by an automated applicator in a generally flat fashion.

While the adhesive membrane is preferably a self-adhesive label, it may also take other forms. For example, it may be a heat sealable lidding film of plastic, foil or other sheet material.

If desired, the adhesive membrane may have a perforation or other area of weakness locatable at or adjacent the edge of the first planar area within the substantially flat area. The purpose of this is to simplify opening of the container by the consumer.

If there are two or more first planar areas and second planar areas, the adhesive membrane may be applied to all of these, or some of these, or to one first planar area and one second planar area only.

If desired, the container of the embodiments may be designed so as to be nestable or stackable with identical or similar containers.

BRIEF DESCRIPTION OF THE DRAWINGS

The embodiments will now be described in relation to certain non-limiting examples thereof in the accompanying drawings, in which.

DETAILED DESCRIPTION OF THE DRAWINGS

Figure 1:
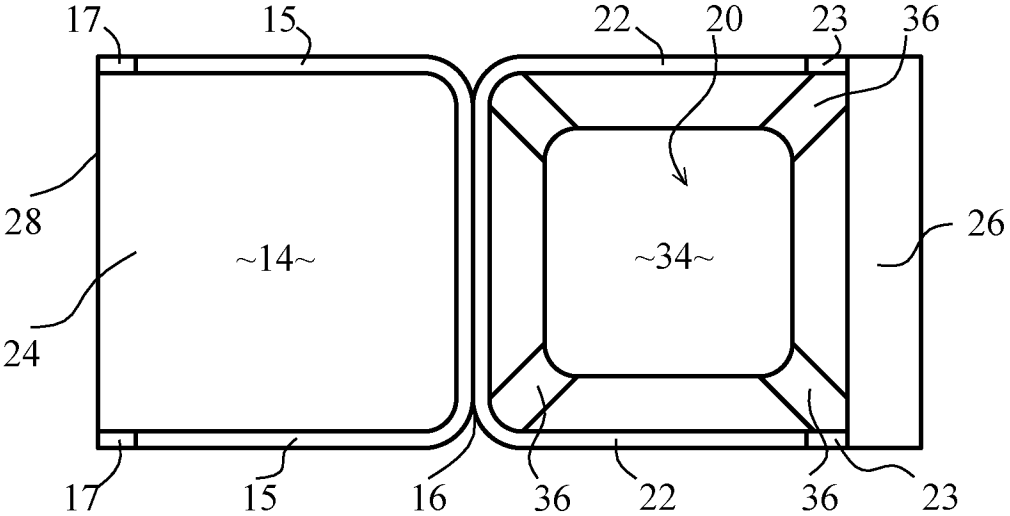
FIG. 1 is a plan view of a first embodiment of container, showing a lid, hinged to the base in the open position.
Figure 2:
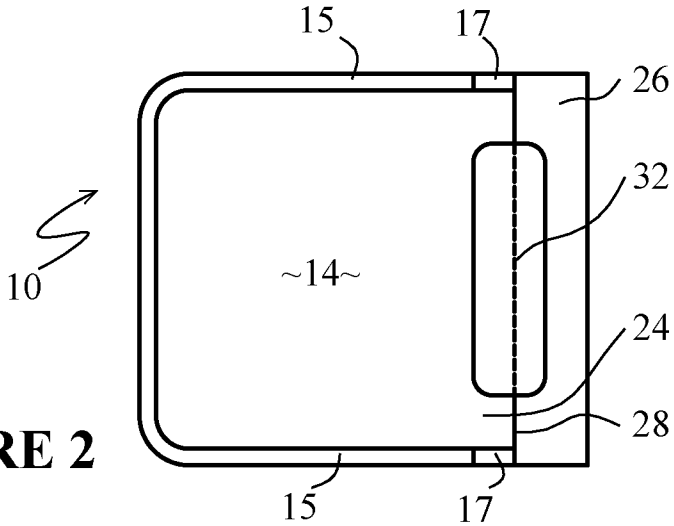
FIG. 2 corresponds to the embodiment in FIG. 1, but showing the lid in the closed position.
Figure 3:
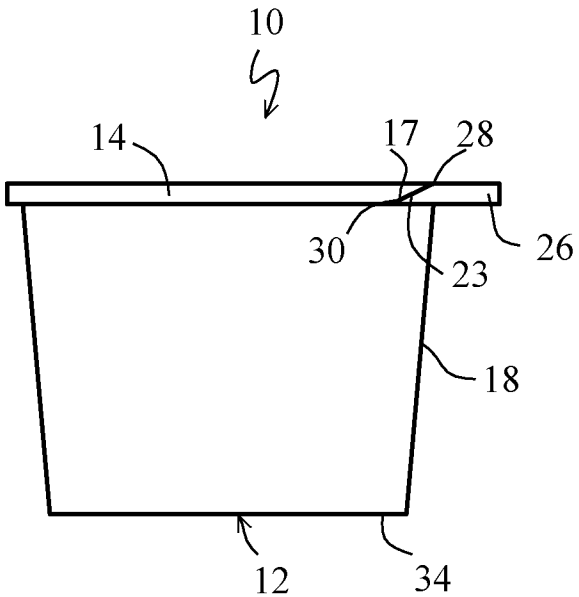
FIG. 3 is a side elevation of the embodiment of FIGS. 1 and 2, with the lid in the closed position.
Figure 4:
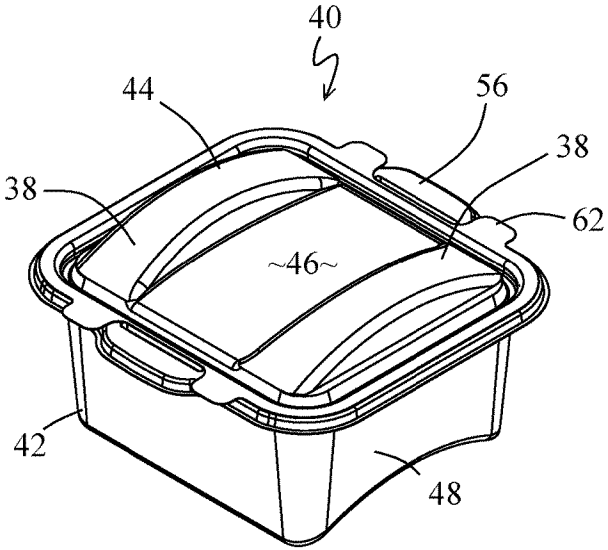
FIG. 4 is a perspective view of a second embodiment of container, having a lid separate from the base.

Referring first to FIGS. 1, 2 and 3, the first embodiment of the container, designated generally as 10, has a base 12 and a lid 14, hinged to base 12 at hinge 16. Rims 15 have ramp portions 17.

Base 12 has upwardly extending sidewalls 18 defining an opening 20 through which products are inserted into container 10 before lid 14 is closed. At the top end of walls 18 of base 12 are rims 22 (refer FIG. 1), each of which has a ran 1*p* portion 23.

Lid 14 in this embodiment has a first planar area 24 which, in this embodiment, comprises virtually the whole of lid 14. The second planar area is formed by rim portion 26 which, as can be seen in FIG. 1, is wider than rims 22. Ramp portion 23 is inclined upwardly from rim 22 to rim 26.

In the closed position, illustrated in FIG. 2, first planar area 24 has mated with second planar area—rim 26—to form a substantially flat area in which edge 28 of lid 14 has mated with rim 26 of base 12, chamfer 30 being formed between them, using ramp portion 23. Adhesive label 32 is shown in place in FIG. 2.

As can be seen in FIG. 1, sidewalls 18 of base 12 are tapered towards floor 34, comers 36 being rounded as illustrated. Margin 15 on lid 14 can include locking means to lock lid 14 to base 12 via rims 22.

Turning now to the second embodiment illustrated in FIGS. 4 to 9, the container, designated generally as 40, has a base 42 and a separate lid 44, with upwardly extending side walls 48 defining an opening 50 through which product may be inserted before lid 44 is closed. Base 42 has a rim 52 with a pair of enlarged portions 56, comprising in this embodiment second planar areas.

Lid 44 has a first planar area 54 defined by ribs 38 and edges 55.

A single label (not shown) can extend over the whole of first planar area 54 and both second planar areas 56. Alternately, two separate labels may be used, the first covering part of first planar area 54 and one of the adjacent second planar areas 56, while the over covers part of first planar area 54 and the adjacent second planar area 56, leaving free central portion 46 of lid 44.

Figure 6:
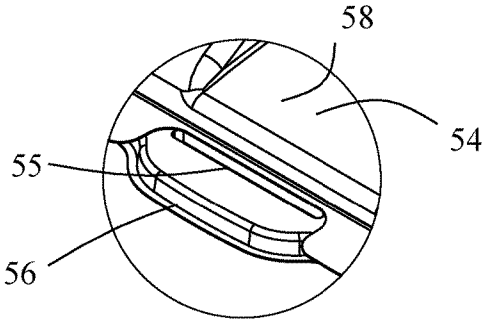
FIG. 6 is a detail of the circled portion of FIG. 4.
Figure 5:
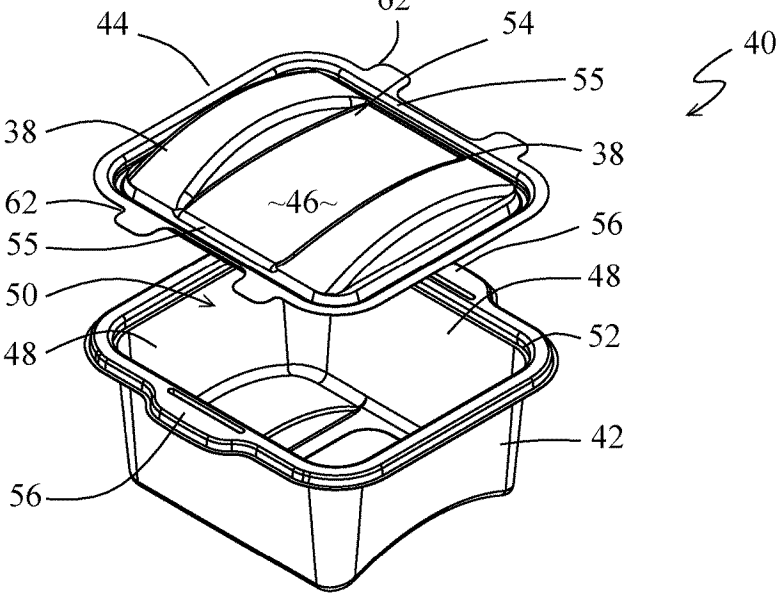
FIG. 5 is an exploded view of the embodiment in FIG. 4.
Figure 7:
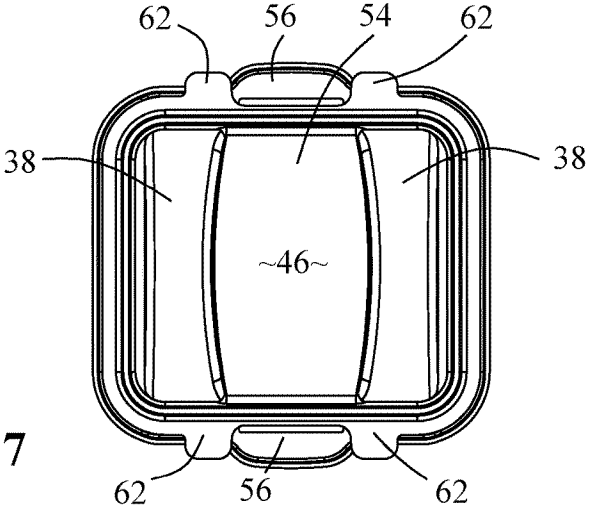
FIG. 7 is a top plan view of the embodiment of FIG. 4.

As shown in FIG. 6, each of second planar areas 56 may include an aperture or recess 58. A sharp object may be inserted through a label (not shown) covering first planar area 54, second planar area 56 and aperture 58, to tear the label through aperture 58, to assist in removing lid 44 from base 42.

In this embodiment, lid 44 also includes removal tabs 62, to assist in removing lid 44 from base 42.

Figure 8:
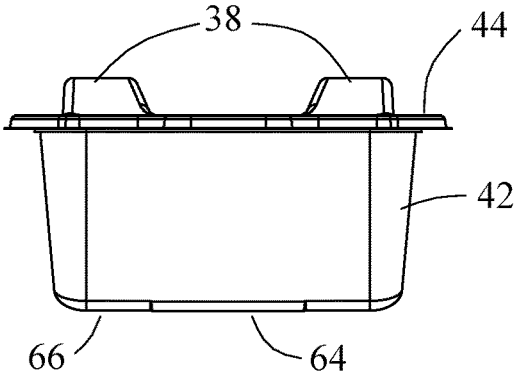
FIG. 8 is a front elevation of the embodiment of FIG. 4.
Figure 9:
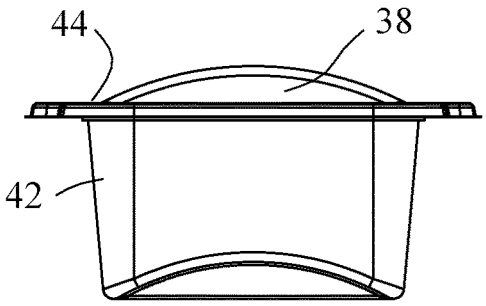
FIG. 9 is a side elevation of the embodiment of FIG. 4.

Container 40 may include vents (not shown) and depression 64 in floor 66 of base 42, as desired (refer FIG. 8). Container 40 may also include one or more recessed portions in lid 44. These may be included in central portion 46 or in another desired location. It is preferred that any such recessed portion is sealed by a label.

Figure 10:
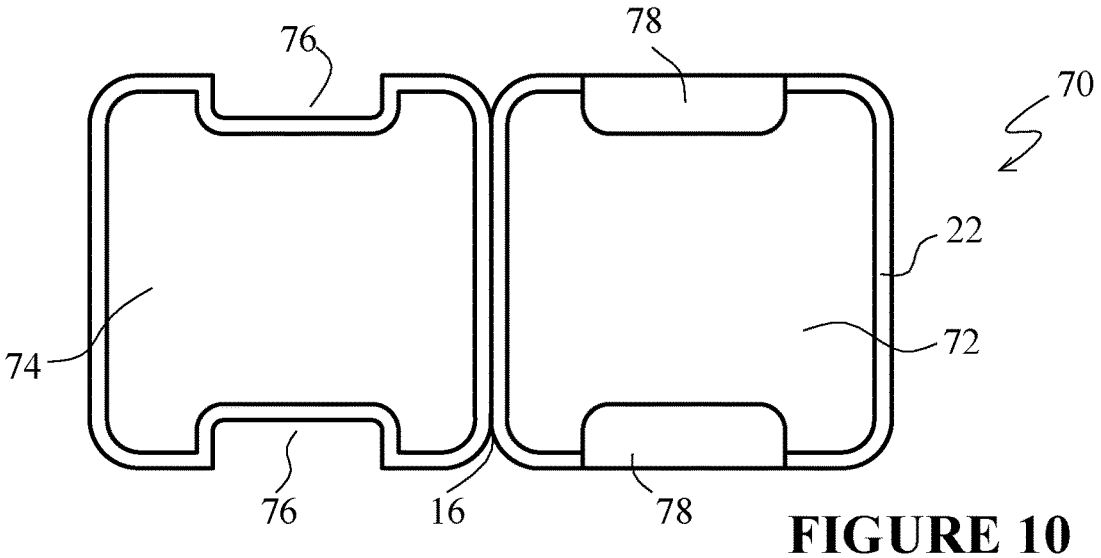
FIG. 10 is a top plan view of a further embodiment in the open position.
Figure 11:
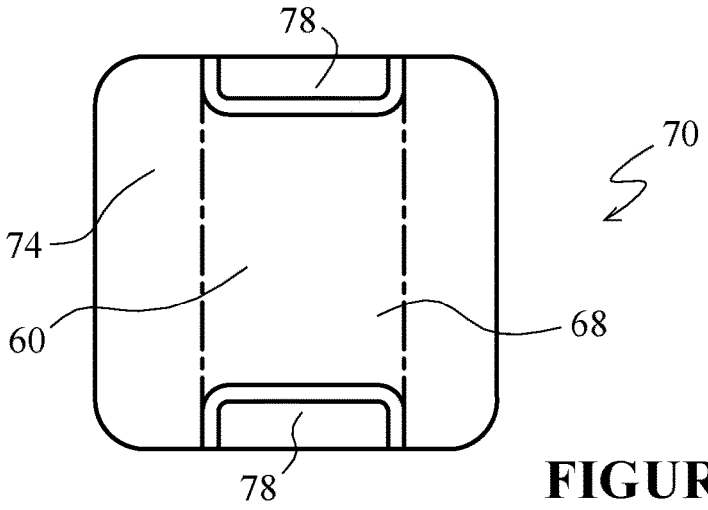
FIG. 11 is a top plan view of the embodiment of FIG. 10, showing the lid in the closed position.

A third embodiment is shown in FIGS. 10 and 11, where container 70 has base 72 hinged to lid 74 at 16. Lid 74 is cut away at 76 and base 72 has flat portions 78. As can be seen in FIG. 11, when lid 74 is closed on base 72, cut aways 76 leave flat portions 78 exposed. When a label 60, shown in dotted outline in FIG. 11, is placed over first planar area 68 of lid 74 and over flat portion 78 (second planar areas) of base 72, lid 74 is effectively sealed to base 72. Flat portions 78 stand proud of rim 22, so that when exposed by cut-outs 76 of lid 74, first planar area 68 is substantially co-planar with flat portions 78.

Figure 13:
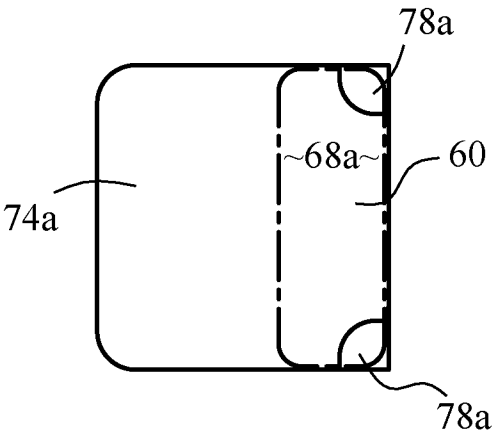
FIG. 13 is a top plan view of the embodiment of FIG. 12 in the closed position.
Figure 12:
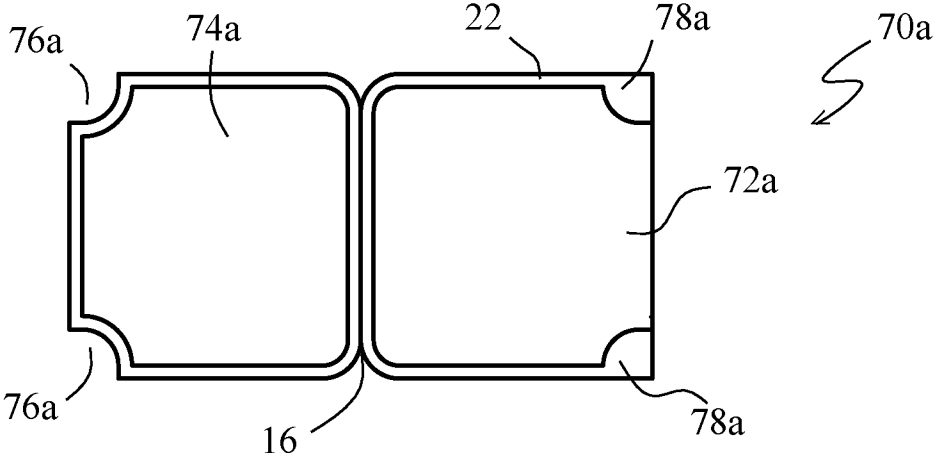
FIG. 12 is a top plan view of a further embodiment in the open position.

The next embodiment in FIGS. 12 and 13 is similar to that in FIGS. 10 and 11 and the same numbers have been used to indicate the same or similar parts, with the addition of the letter "a". Whereas in the FIGS. 10 and 11 embodiment the cut-away portions 76 on lid 74 were centered in an edge of lid 74, in the FIGS. 12 and 13 embodiment cut-away portions 76*a* are located in two opposite corners of lid 74*a*.

Similarly, flat portions 78*a* are located at comers of base 72*a*.

As was the case with the previous embodiment, when lid 74*a* is closed on base 72*a*, flat portions 78*a* are substantially co-planar with first planar area 68*a*.

Figure 15:
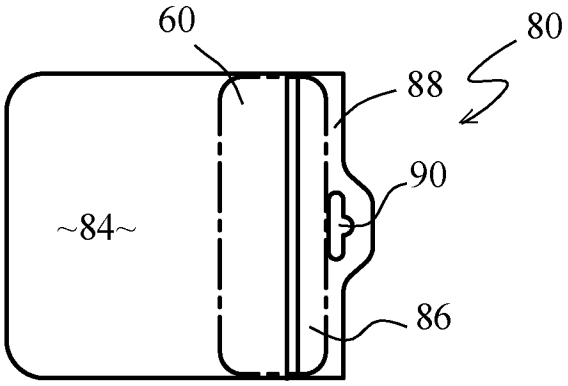
FIG. 15 is a top plan view of the embodiment of FIG. 14 in the closed position.
Figure 14:
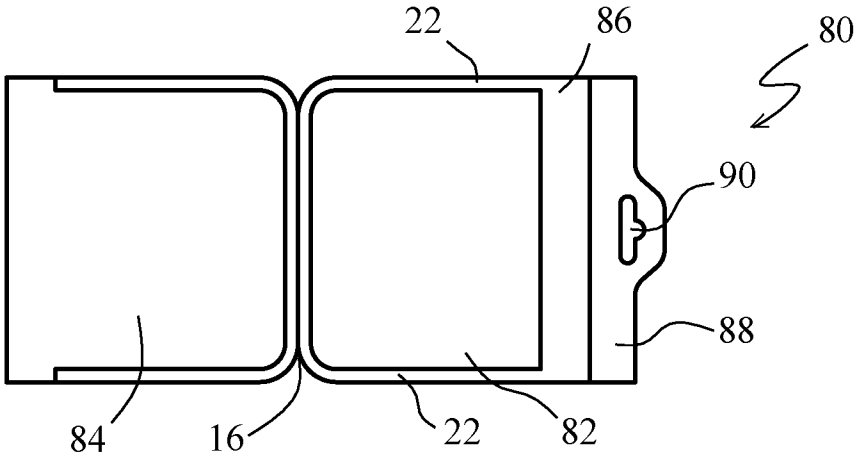
FIG. 14 is a top plan view of a further embodiment in the open position.

The next embodiment shown in FIGS. 14 and 15 shows container 80 having base 82 and lid 84. Base 82 has narrow rims 22 and expanded rim 86. Expanded rim 86 includes further portion 88 with hang sell hole 90, to enable container 80 to be displayed on a hanger.

Expanded rim 86 is designed so that, when lid 84 is closed on container 82, expanded rim 86 is substantially co-planar with lid 84, which in this embodiment comprises the first planar area.

As can be seen in FIG. 15, label 60 can be affixed to cover the right-hand side of lid 84 and expanded rim 86.

Figure 16:
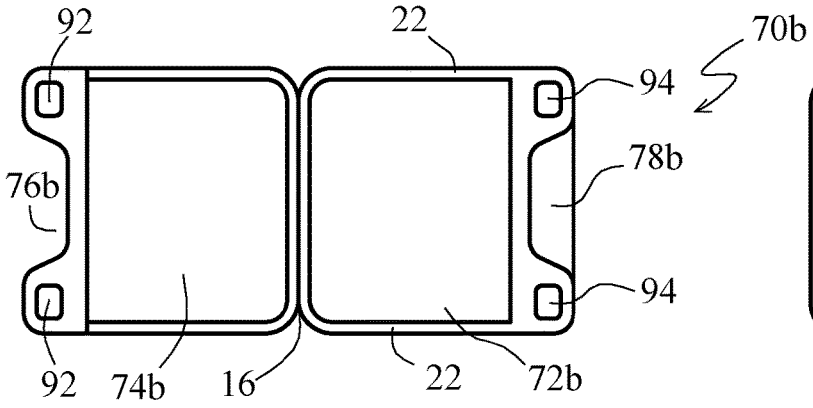
FIG. 16 is a top plan view of a further embodiment in the open position.
Figure 17:
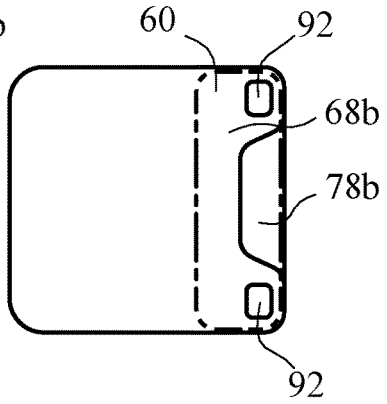
FIG. 17 is a top plan view of the embodiment of FIG. 16 in the closed position.

The embodiment in FIGS. 16 and 17 is similar to that shown in FIGS. 10 and 11 and 12 and 13. The same labels will be used to designate the same or similar parts, with the addition of the letter "b".

Container 70*b* has base 72*b* and lid 74*b*, hinged at 16. Cut-away 76*b* on lid 74*b* is designed to expose flat portion 78*b* on base 72*b* in the closed position (FIG. 17). Flat portion 78*b* stands proud of rim 22 so that first planar area 68*b* is substantially co-planar with flat portion 78*b*.

This embodiment includes lock lugs 92 designed for a friction fit into lock recesses 94 on base 72*b*. As can be seen from FIG. 17, when label 60 is affixed, it covers not only first planar area 68*b* and flat portion 78*b* but also lock lugs 92.

The embodiments in FIGS. 18 to 21 illustrate how the first and second planar areas may be disposed at an angle to the lid and to a rim on the base.

Figure 18:
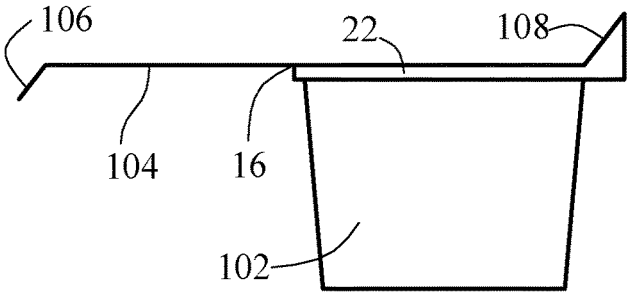
FIG. 18 is a side elevation of a further embodiment, where the first and second planar areas are at an angle to the base and lid, the lid being in the open position in this Figure.
Figure 19:
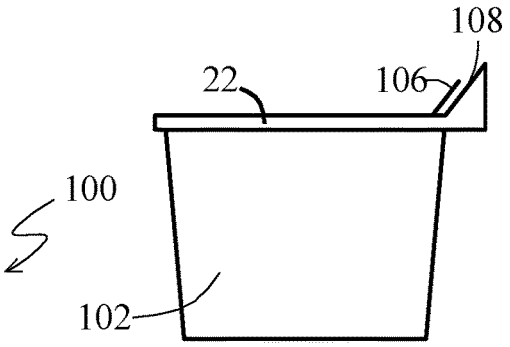
FIG. 19 shows the embodiment of FIG. 18, with the lid in the closed position.

Referring first to FIGS. 18 and 19, container 100 has lid 104 hinged to base 102 at 16. Lid 104 includes extension 106 which, in use, is inclined upwardly at an obtuse angle from lid 104.

Base 102 has rim 22 which has extension 108, in use inclined at an obtuse angle from rim 22.

In the closed position, extension 106 is designed to mate with extension 108. Extension 106 has one or more cut-outs, similar to those already illustrated in FIGS. 10 to 13 or 16 and 17, so that a flat label 60 applied to extension 106 will bind extension 106 to extension 108, exposed by the cut-out or cut-outs.

Figure 20:
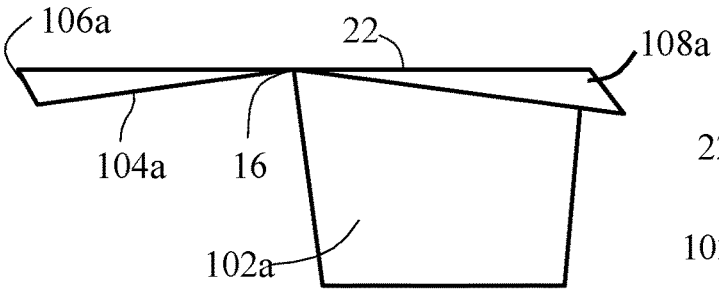
FIG. 20 is a side elevation of a further embodiment where the first and second planar areas are at an angle to the lid and base, showing the open position.
Figure 21:
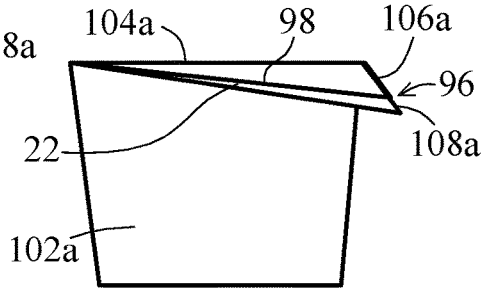
FIG. 21 shows the embodiment in FIG. 20 in the closed position.

The embodiment in FIGS. 20 and 21 is a variation of that in FIGS. 18 and 19 and the same labels will be used, with the addition of the letter "a". In this embodiment, lid 104*a* ends in flat portion 106*a*. Rim 22 on base 102*a* has a downwardly extending extension 108*a*.

In the closed position, extension 106*a* mates with extension 108*a* along margin 98 to provide a substantially co-planar surface 96 on which a label 60 (not shown) may be placed to seal lid 104*a* to base 102*a*.

It will be apparent to one skilled in the art that the embodiments in FIGS. 18 to 21 may be adapted to containers with separate lids. In that case, it is preferred that there are two extensions 106 (or 106*a*) and two extensions 108 (or 108*a*).

Figure 23:
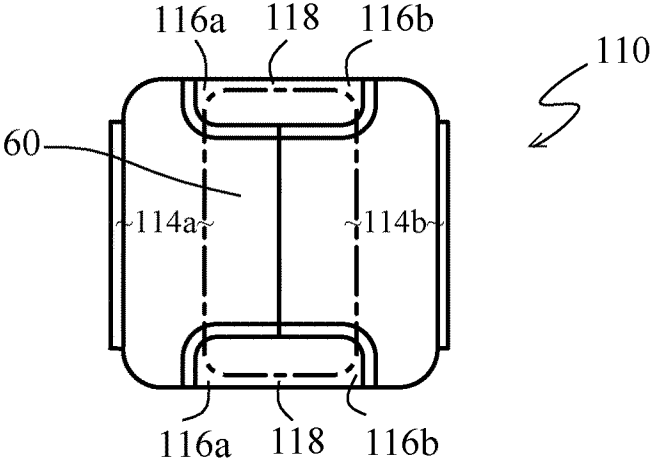
FIG. 23 shows the FIG. 22 embodiment with the lid parts in the closed position.
Figure 22:
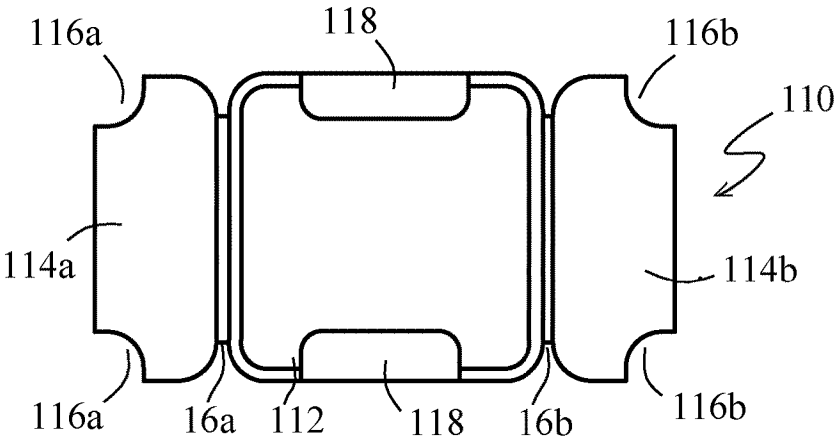
FIG. 22 is a top plan view of a further embodiment wherein the lid is in more than one part, showing the lid parts in the open position.

Reference is now made to the embodiment in FIGS. 22 and 23. In this embodiment, container 110 has base 112 as shown in FIG. 22. However, the lid is in two parts, 114*a* and 114*b*. Lid part 114*a* is hinged to base 112 at 16*a* while lid part 114*b* is hinged to base 112 at hinge 16*b*.

Each of lid parts 114*a* and 114*b* has a pair of cut-aways, 116*a* and 116*b*. When lid parts 114*a* and 114*b* are in the closed position as shown in FIG. 23, cut-aways 116*a* and 116*b* expose flat portions 118 on base 112. Lid parts 114*a* and 114*b* may meet or overlap in known manner, for example as described in Australian patent specification No 2003234951, the contents of which are incorporated herein by reference. Nevertheless, each of lid parts 114*a* and 114*b* provide a first planar area which is substantially co-planar with flat portion 118 on base 112. In this way, when lid parts 114*a* and 114*b* are in the closed position, label 60 can be applied on the substantially flat area so provided.

Figure 25:
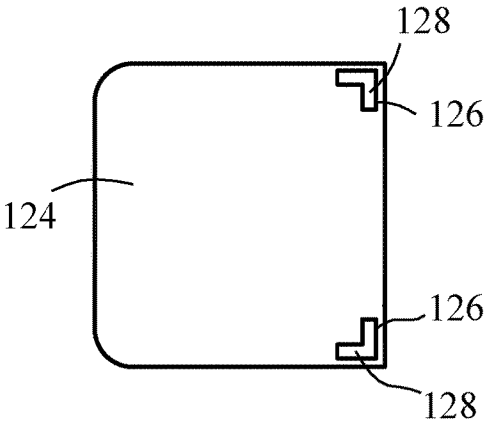
FIG. 25 shows the FIG. 24 embodiment in the closed position.
Figure 24:
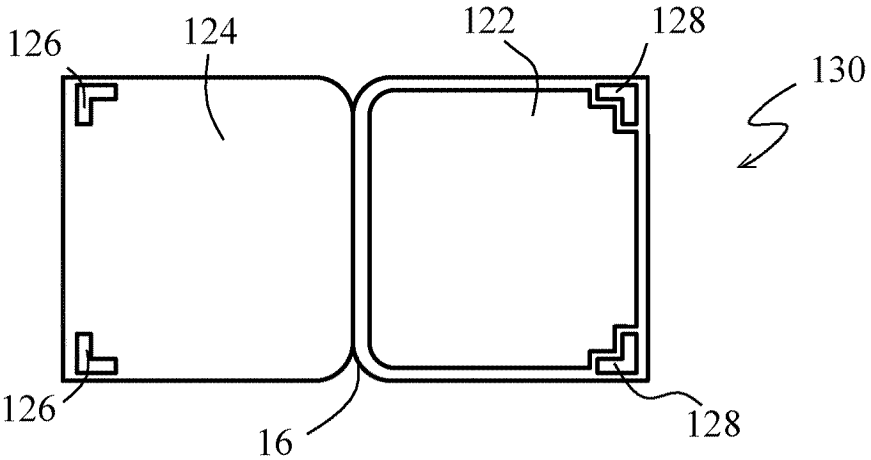
FIG. 24 is a top plan view of a further embodiment, showing the open position.

Referring now the embodiment in FIGS. 24 and 25, container 130 has base 122 hinged to lid 124 at hinge 16. Lid 124 has diecut holes 126. Lid 124 is generally flat to provide the first planar area.

Base 122 has formed sections 128, the top, flat part of which comprise the second planar areas. As can be seen by FIG. 25, in the closed position formed sections 128 mate with diecut holes 126 to form a substantially flat surface. A label (not shown) may be applied to cover both formed sections 128 and the intervening part of lid 124. Alternately, separate labels may be applied.

Figure 26:
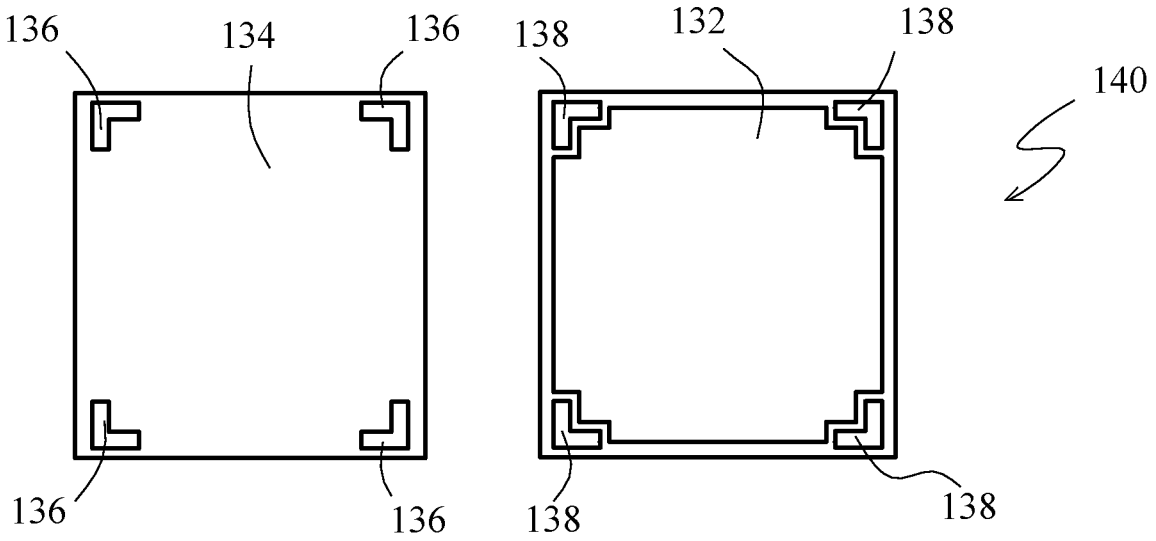
FIG. 26 shows yet a further embodiment, being a top plan view in the open position.
Figure 27:
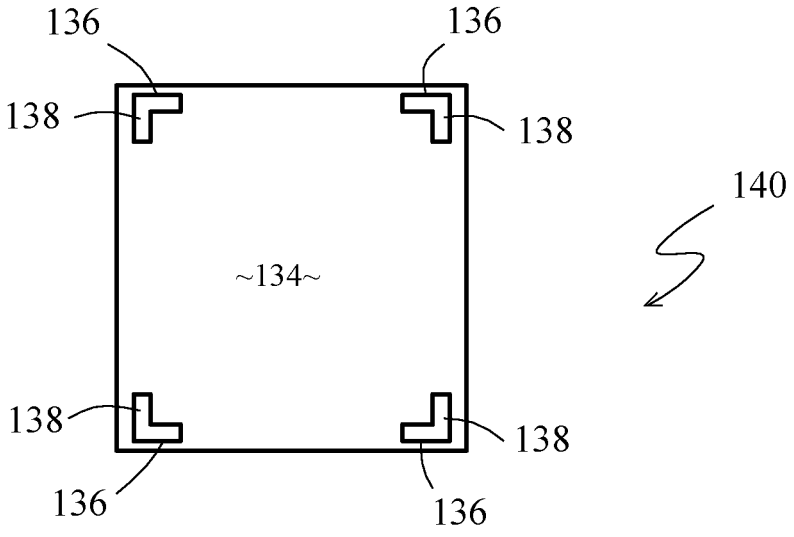
FIG. 27 shows the FIG. 26 embodiment in the closed position.

The embodiment in FIGS. 26 to 27 is similar to that in FIGS. 24 to 25; however, in container 140 in FIGS. 26 to 27, base 132 is separate from lid 134. In addition, there are four diecut holes 136 and correspondingly four formed sections 138. Like the embodiment in FIGS. 24 and 25, when lid 134 which is of the "outside fitting" type, is placed on base 132, sections 138 protrude into diecut holes 136 to provide a substantially flat area for label application.

It will be appreciated from the various embodiments described above that the container can be produced in a wide number of forms and that, in addition, a single form may be suitable for application of different types of labels. Lids may be hinged or separate.

Lids may be substantially flat or they may be shaped, with ridges, ribs, domes as non-limiting examples of shaping. Especially in the case of substantially flat lids, these may be designed to mate with the base so that the second planar area or areas can appear on, for example, opposing sides of the lid, opposing comers of the lid or on one side of the lid, opposite the hinge. In the case of a lid which is a dual lid, with two hinges, the second planar areas may be on two opposing sides (viewing the closed lid in plain view), or on four comers, for example.

In the case of a separate lid, once again viewing the container in plain view in the closed position, the second planar areas may be in each of four comers, on two opposing sides, on two diagonal comers, around all four sides or separately on each of four sides. These are a selection only of possible combinations. Others will be apparent to one skilled in the art.

INDUSTRIAL APPLICABILITY

The container can be adapted to any currently known container design, whether having a single lid or a multi-part lid. The embodiments allow for manual or high speed automatic closure and flat, self-adhesive label application providing tamper evidence, while at the same time employing a minimum number of moving parts.

The container can offer important tamper evidence capabilities while maintaining minimal obstruction of vision through the container lid. For certain applications, the container will also allow alternate graphic methods to be successfully used, such as pre-printing, branding and nutritional information onto the lid area, thus reducing label requirements to a smaller, basic tamper evident label only.

The invention claimed is:

1. A container for packaging a product, the container comprising:

a base having a floor;

a lid movable about a hinge with respect to the base from an open position to a closed position, wherein the closed position defines a cavity inside the container between the floor and the lid;

the base, lid, and hinge having a unitary construction from a material having a generally defined thickness between a first material surface and a second material surface disposed on immediately opposite sides of the material, wherein at least a portion of the first material surface is parallel to an immediately opposite portion of the second material surface;

the cavity having a base portion dimensioned to contain a first portion of the product in the base and a lid portion dimensioned to contain a second portion of the product in the lid, and wherein the lid portion is disposed beyond the base and outward from the base portion, and the cavity is generally defined by the second material surface;

the lid having a substantially flat top disposed parallel to the floor when the lid is in the closed position, a substantially planar frontal extension extending from the substantially flat lid top to a bottom edge of the lid, wherein the bottom edge is between, and outward from both, the substantially flat lid top and the floor when the lid is in the closed position, the substantially planar frontal extension extends obliquely relative to the floor from the substantially flat lid top when the lid is in the closed position, having a first planar area on the substantially planar frontal extension's portion of the first material surface, and having a first lid hole fully encompassed within a substantially planar lid area;

the base having a sidewall extending from the floor to a base rim that generally defines an opening for the base portion of the cavity, wherein the sidewall and floor each includes portions of both the first and second material surfaces;

a base extension extending from the base, having a primary surface area with a flat portion facing external to the cavity wherein the flat portion is bounded by a first boundary and a second boundary, a second planar area on the flat portion disposed obliquely to the floor, and a secondary surface area that is on the direct opposite side of the material from the flat portion and is an extension of the sidewall's portion of the first material surface; and wherein in the closed position the first planar area, the second planar area, and the first and second boundaries of the flat portion are all generally coplanar, a first flat portion of a label covers both the primary surface area of the base extension and the substantially planar lid area of the substantially planar frontal extension, and the primary surface area is adjacent to the substantially planar lid area of the substantially planar frontal extension.

2. The container of claim 1 wherein the lid has a lid rim that generally defines an opening for the lid portion of the cavity, the bottom edge of the lid is located on the lid rim, and the first flat portion of the label fully extends from adjacent the substantially flat top to the bottom edge of the lid.

3. The container of claim 1 wherein the first lid hole is fully circumscribed by a planar lid hole edge of the substantially planar lid area.

4. The container of claim 3 wherein the base extension extends into the first lid hole when the lid is in the closed position, and the bottom edge of the lid is distant from the floor when the lid is in the closed position.

5. The container of claim 1 wherein the label has a second flat portion located between a third flat portion and the first flat portion of the label, wherein the second flat portion is located on the substantially flat top of the lid, and the first flat portion is separated from the third flat portion by the width of the substantially flat top of the lid.

6. The container of claim 1 wherein the bottom edge of the lid extends from nearly adjacent the first lid hole to nearly adjacent a second lid hole in the substantially planar lid area of the substantially planar frontal extension, and the base has a rectangular cross section.

7. The container of claim 6 wherein between the first lid hole and the second lid hole the bottom edge of the lid has a convex curvature, and the base and lid are thermoformed from the material.

8. The container of claim 1 wherein the floor of the base has a length and a width, wherein the length of the floor is bounded by a first end and a second end, and the substantially planar frontal extension fully extends the length of the floor.

9. The container of claim 8 wherein the label fully extends the length of the floor.

10. The container of claim 1 wherein the first lid hole is entirely located between the bottom edge of the lid and the substantially flat top of the lid, and the lid includes a plurality of domes adjacent to and flanking the substantially flat top.

11. A container for packaging a product, the container comprising:

a base having a floor;

a lid moveable about a hinge with respect to the base from:

a substantially open position to a substantially closed position, wherein the substantially closed position substantially defines a cavity disposed substantially inside the container between the floor and the lid, the base and lid both formed from a container material;

the cavity having a base portion of the cavity dimensioned to contain at least a first portion of the product disposed substantially inside the base, and a lid portion of the cavity having a shape suitable to contain at least a second portion of the product disposed outside the base portion of the cavity when the lid is in the substantially closed position, wherein the lid portion of the cavity is disposed at least generally beyond the base and generally outward from the base portion of the cavity;

the container material having a material thickness generally defined by a first material surface disposed on an immediately opposite side of the container material to a second material surface, and wherein a portion of the first material surface is substantially parallel with respect to an immediately opposite portion of the second material surface;

the lid having a substantially flat lid top area disposed at least generally parallel to the floor when the lid is in the substantially closed position and including a lid top portion of the first material surface disposed on a first predominantly external lid surface area, a substantially planar frontal extension extending from the substantially flat lid top area to a bottom edge of the lid, wherein the bottom edge of the lid is between the substantially flat lid top area and the floor when the lid is in the substantially closed position and beyond an area directly between the substantially flat lid top area and floor when the lid is in the substantially closed position, and having a lid front portion of the first material surface disposed on a second predominantly external lid surface area extending generally downwardly from the substantially flat lid top area when the lid is in the substantially closed position and the floor is positioned substantially horizontal with the substantially flat lid top area located above the floor, wherein the substantially planar frontal extension is disposed facing substantially upwardly with respect to the floor, and a lid end portion defined generally at a margin of the lid, and a lid hole substantially defined in the container material by a lid hole edge and fully encompassed within a substantially planar lid area, wherein the second material surface of the substantially flat lid top area and the second material surface of the substantially planar frontal extension intersect at an obtuse angle;

the base having the floor wherein, with respect to the cavity, the floor comprises an external floor surface area disposed on the first material surface and an internal floor surface area disposed on the second material surface, a sidewall extending generally upwardly from the floor having, with respect to the cavity, a predominantly external sidewall surface area disposed on the first material surface and a predominantly internal sidewall surface area disposed on the second material surface, a rim wherein, a portion of the rim partially defines a base opening suitable for at least partial receipt of the product into the base portion of the cavity, and a base extension generally extending from the rim, the base extension comprising a primary surface area disposed facing substantially externally with respect to the base portion of the cavity, wherein the primary surface area comprising a flat portion disposed on an extension of the predominantly internal sidewall surface area of the second material surface, and wherein the base extension having a secondary surface area on an immediately opposite side of the container material to the flat portion of primary surface area, the secondary surface area disposed on an extension of the predominantly external sidewall surface area of the first material surface wherein when the lid is in the substantially closed position, the substantially planar frontal extension is disposed obliquely to the floor and projects generally away from the hinge from, the substantially flat lid top area to, the lid end portion, wherein the substantially planar frontal extension terminates substantially at the margin;

a label covering the substantially flat lid top area of the lid, having a substantially flat portion covering the substantially planar frontal extension, wherein the label extends beyond the substantially planar frontal extension, when the lid is in the substantially closed position, the label covers the flat portion of the base extension; and the lid having a first planar area disposed on the substantially planar frontal extension, the base having a second planar area disposed on the flat portion of the primary surface disposed obliquely to the floor, wherein the first planar area and the second planar area are generally coplanar and disposed facing externally with respect to the cavity when the lid is in the substantially closed position.

12. The container of claim 11 wherein, in the substantially closed position, both, the lid hole and the lid hole edge are entirely encompassed within the substantially planar frontal extension, and the first planar area has a surface area greater than 5 $cm^2$.

13. The container of claim 11 wherein the substantially flat lid top area has a width disposed generally between the hinge and the substantially planar frontal extension;

the label has a first flat portion encompassing the substantially flat portion, a second flat portion covering the substantially flat lid top area, and a third flat portion, wherein the first flat portion is separated from the third flat portion by the width of the substantially flat lid top area.

14. A container for packaging contents intended for sale wherein, the contents comprising a product, the container comprising:

a container material substantially comprising a base, a floor and, a lid moveable with respect to the base from, at least one substantially open position to, at least one substantially closed position wherein, the at least one substantially closed position substantially defining a cavity disposed substantially inside the container between the floor and the lid;

the cavity comprising:

a base portion of the cavity to contain at least a first portion of the product disposed substantially inside the base; and a lid portion of the cavity modified to contain at least a second portion of the product disposed substantially outside the base portion of the cavity wherein, the container material further comprising:

a material thickness having a dimension generally defined by two material surfaces wherein, a first of the two material surfaces is disposed on an immediately opposite side of the container material with respect to a second of the two material surfaces and wherein, at least one portion of the first of the two material surfaces is disposed substantially parallel with respect to an immediately opposite portion of the second of the two material surfaces;

the lid comprising:

the lid portion of the cavity comprising a shape suitable to contain at least the second portion of the product disposed outside the base when the lid is in the at least one substantially closed position wherein, the lid portion of the cavity is disposed at least generally beyond the base and generally outwardly with respect to the base portion of the cavity;

a hinged attachment to the base disposed generally adjacent to a hinged side of the lid wherein, the lid is movable about the hinged attachment between, the at least one substantially open position and, the at least one substantially closed position;

a substantially flat lid top area disposed at least generally parallel to the floor when the lid is in the at least one substantially closed position wherein, the substantially flat lid top area comprising a lid top portion of the first of the two material surfaces disposed on a first predominantly external lid surface area;

a substantially planar frontal extension comprising a lid front portion of the first of the two material surfaces disposed on a second predominantly external lid surface area extending generally downwardly from the substantially flat lid top area wherein, when the lid is in the at least one substantially closed position and the floor is positioned substantially horizontally, the substantially planar frontal extension is disposed facing substantially upwardly with respect to the floor and, wherein comprising a lid end portion defined generally at a margin of the lid wherein, the substantially planar frontal extension is inclined at a reflex angle of less than 270 degrees with respect to the substantially flat lid top area; and at least one lid hole comprising an opening substantially defined in the container material by a lid hole edge wherein, the at least one lid hole is fully encompassed within a substantially planar lid area having the lid hole edge;

the base comprising:

the floor wherein, with respect to the cavity, the floor comprising, at least one external floor surface area disposed on the first of the two material surfaces and at least one internal floor surface area disposed on the second of the two material surfaces;

at least one sidewall extending generally upwardly from the floor and comprising, with respect to the cavity, a predominantly external sidewall surface area disposed on the first of the two material surfaces and a predominantly internal sidewall surface area disposed on the second of the two material surfaces;

a rim wherein, at least one portion of the rim partially defines a base opening suitable for at least partial receipt of the product into the base portion of the cavity; and at least one base extension generally extending from the at least one portion of the rim, the at least one base extension comprising a primary surface area disposed facing substantially externally with respect to the base portion of the cavity wherein, the primary surface area comprising a flat portion disposed on an extension of the predominantly internal sidewall surface area of the second of the two material surfaces and, wherein, the at least one base extension comprising a secondary surface area on an immediately opposite side of the container material to the flat portion of primary surface area, the secondary surface area disposed on an extension of the predominantly external sidewall surface area of the first of the two material surfaces wherein, when the lid is in the at least one substantially closed position and the container is orientated wherein the floor is substantially horizontal and the at least one external floor surface area faces substantially downwardly, the substantially planar frontal extension is disposed obliquely to the floor and projects generally downwardly in a direction generally away from the hinged side of the lid from, the substantially flat lid top area to, the lid end portion wherein the substantially planar frontal extension terminates substantially at the margin;

the container further comprising:

a first planar area disposed on the lid, within the bounds of the substantially planar frontal extension; and a second planar area disposed on the flat portion of the primary surface, disposed obliquely with respect to the floor wherein, when the lid is in the at least one substantially closed position, the first planar area and the second planar area face substantially in the same direction wherein, the container comprising;

a substantially flat area, inclined at a reflex angle of less than 270 degrees with respect to the substantially flat lid top area wherein, the substantially flat area comprising:

a circumferential dimension which is substantially less than each of, a largest internal perimeter of the base opening and an outermost perimeter of the lid;

an edge of the first planar area and at least part of the second planar area, disposed facing at least substantially externally with respect to the cavity; and at least one surface configuration between the lid and the base comprising, at least, the first planar area of the lid, at least two distinct boundary portions of the flat portion of the primary surface area and, the flat portion of the primary surface area of the at least one base extension wherein, the flat portion comprising the second planar area disposed substantially co-planar with respect to, both, the lid front portion of the first of the two material surfaces, and the at least two distinct boundary portions, to comprise the substantially flat area, wherein, the substantially flat area is disposed substantially outside of the cavity of the container and is suitable to be covered in a generally flat fashion by a substantially flat portion of an entire label wherein, the entire label is proposed to be received by the container wherein the entire label is larger than the substantially flat area and wherein, the substantially flat portion of the entire label is proposed to contour substantially to the substantially flat area, in the generally flat fashion, to cover at least two immediately adjacent surface portions of the container with respect to the at least one surface configuration wherein, a first of the at least two immediately adjacent surface portions is the entire flat portion of the primary surface area of the at least one base extension and, a second of the at least two immediately adjacent surface portions is disposed on the substantially planar frontal extension wherein, when contouring to the substantially flat area and covering the at least two immediately adjacent surface portions in the generally flat fashion, the substantially flat portion of the entire label is proposed to at least generally contour to an outermost shape of the container including, at least each of, the lid front portion of the first of the two material surfaces of the substantially planar frontal extension, the second planar area and, the at least two distinct boundary portions of the flat portion of the primary surface area of the at least one base extension.

15. The container of claim 14 wherein, the at least one base extension comprising a formed section wherein, the formed section stands proud of the at least one portion of the rim wherein, the second planar area comprising a planar perimeter wherein, a portion of the planar perimeter defines at least two distinct sides of the second planar area and wherein, the at least one lid hole is disposed at least generally adjacent to the first planar area wherein, when the lid is in the at least one substantially closed position, the at least one lid hole corresponds to and mates with the at least two distinct sides of the second planar area, to expose the second planar area wherein, facilitating the at least one surface configuration, to provide the substantially flat area.

16. The container of claim 15 wherein, the lid hole edge is substantially planar and wherein, when the lid is in the at least one substantially closed position, the lid hole edge and the at least one lid hole are entirely encompassed within a perimeter of the substantially flat area.

17. The container of claim 16 wherein, a portion of the margin of the lid extends from, a first opening area adjacent to a first of the at least one lid hole to, a second opening area adjacent to a second of the at least one lid hole wherein, the portion of the margin includes a most forwardly extended point of the lid when the lid is in the at least one substantially closed position wherein, the most forwardly extended point of the lid is generally disposed at the front of the container, on a directly opposite side of the container to the hinged attachment.

18. The container of claim 17 wherein, when the lid is in the at least one substantially closed position, the portion of the margin includes at least one point which is closer, to either of, the first lid hole and the second lid hole, than to the floor of the base.

19. The container of claim 15 wherein, the substantially flat lid top area has a width disposed generally between the hinged side of the lid and the substantially planar frontal extension; the entire label having a first flat label portion, a second flat label portion, and a third flat label portion located between the first and second flat label portions, wherein the first flat label portion comprising the substantially flat portion of the entire label; wherein, when the lid is in the at least one substantially closed position and the entire label is received by the container, the third flat label portion substantially spans the width of the substantially flat lid top area and is located directly above the floor, the first flat label portion is separated from the second flat label portion by the width of the substantially flat lid top area, and the substantially flat area is both, substantially parallel and immediately adjacent with respect to the first flat label portion.

20. The container of claim 15 wherein, when the lid is in the at least one substantially closed position, the at least one lid hole corresponds with the flat portion of the primary surface area wherein, the formed section of the at least one base extension protrudes from the base, generally into the at least one lid hole, to provide the substantially flat area wherein, the substantially flat area is substantially coplanar with the planar perimeter of the flat portion.

21. The container of claim 14 wherein, the container comprising at least one mechanical locking mechanism disposed within the perimeter of the substantially flat area, to lock the lid to the base when the lid is in the at least one substantially closed position.

22. The container of claim 21 wherein, when the lid is in the at least one substantially closed position, the margin of the lid extends from a first lock area adjacent to a first of the at least one mechanical locking mechanism to a second lock area adjacent to a second of the at least one mechanical locking mechanism;

wherein between the first lock area and the second lock area, the margin has at least one convex curvature portion.

23. The container of claim 21 further comprising a chamfered abutment of an edge of the first planar area and at least a part of the second planar area disposed within the perimeter of the substantially flat area.

24. The container of claim 21 wherein, the first planar area and the second planar area partially overlap when the lid is in the at least one substantially closed position;

further comprising an overlap of a lid material portion and a base material portion, disposed within the perimeter of the substantially flat area when the lid is in the at least one substantially closed position.

25. The container of claim 24 wherein, the overlap includes the first planar area located adjacent to the second planar area and disposed within the perimeter of the substantially flat area.

26. The container of claim 25 wherein, first planar area of the overlap is separated from the second planar area of the overlap by the dimension of the material thickness.

27. The container of claim 25 wherein, the substantially flat area is covered with the substantially flat portion of the entire label in the generally flat fashion, to span the overlap.

28. A container for packaging a product, the container comprising:

a base having a floor;

a lid movable about a hinge with respect to the base from an open position to a closed position, wherein the closed position defines a cavity inside the container between the floor and the lid;

the base, lid, and hinge having a unitary construction from a material having a generally defined thickness between a first material surface and a second material surface disposed on immediately opposite sides of the material, wherein at least a portion of the first material surface is parallel to an immediately opposite portion of the second material surface;

the cavity having a base portion dimensioned to contain a first portion of the product in the base and a lid portion dimensioned to contain a second portion of the product in the lid, and wherein, when the lid is in the closed position, the lid portion of the cavity is disposed beyond the base and adjacent to the base portion of the cavity, and the cavity is generally defined by the second material surface;

the lid having a lid area comprising a first area disposed on the first material surface to face substantially externally with respect to the cavity when the lid is in the closed position;

the base having a sidewall extending from the floor to a base rim that generally defines an opening for the base portion of the cavity, wherein the sidewall and floor each includes portions of both the first and second material surfaces; and a base extension extending from the base, comprising a base area having a second area configured to face substantially externally with respect to the cavity when the lid is in the closed position;

wherein, when the lid is in the closed position, a label location area is disposed substantially on a first part of the first area of the lid and a first part of the second area of the base extension, the first part of the first area is adjacent to the first part of the second area and substantially coplanar to an adjacent flat part of the lid area, and the first part of the first area of the lid surrounds the first part of the second area of the base extension, the label location area is configured to receive, on an outermost part of the container, a flat portion of a label that is substantially coplanar to the adjacent flat part of the lid area, covers the first part of the first area and the first part of the second area, and transverses the label location area.

29. The container of claim 28 wherein, when the lid is in the closed position the base rim is located between the second area of the base extension and the floor of the base;

the product is located within the cavity;

the container includes the flat portion of the label;

the base includes ribs adapted hold the product;

the lid further includes a substantially flat lid top area and, when the lid is in the closed position, the label location area is inclined at a reflex angle of less than 270 degrees with respect to the substantially flat lid top area.

30. The container for packaging the product of claim 29 wherein, the product is fresh retail produce;

the first area includes an edge portion comprising an edge of the material; and when the lid is in the closed position the second area of the base extension and the first area of the lid face substantially in the same direction, and the second area is disposed substantially adjacent to the edge portion of the first area of the lid.

* * * * *